United States Patent [19]

Bertram et al.

[11] 4,322,076

[45] Mar. 30, 1982

[54] BALL-PLAYING RACKET

[75] Inventors: Hans Bertram; Leo Ramesohl, both of Essen, Fed. Rep. of Germany

[73] Assignee: Marsteller & Killmann KG, Essen, Fed. Rep. of Germany

[21] Appl. No.: 151,462

[22] Filed: May 19, 1980

[30] Foreign Application Priority Data

May 22, 1980 [DE] Fed. Rep. of Germany ..... 2920680

[51] Int. Cl.[3] ..... A63B 51/00

[52] U.S. Cl. ..... 273/73 D; 273/73 G

[58] Field of Search ..... 273/73 R, 73 C, 73 D, 273/73 E, 73 G, 73 H

[56] References Cited

U.S. PATENT DOCUMENTS

| | | | |
|---|---|---|---|
| 1,663,039 | 3/1928 | Craven | 273/73 E |
| 1,790,156 | 1/1931 | Kleinman | 273/73 E |
| 2,165,701 | 7/1939 | Goerke | 273/73 E |
| 2,206,548 | 7/1940 | Goerke | 273/73 E |
| 4,026,553 | 5/1977 | Vendramini | 273/73 E |
| 4,099,717 | 7/1978 | Sacks | 273/73 E |
| 4,138,109 | 2/1979 | Nobbs | 273/73 G |
| 4,196,901 | 4/1980 | Durbin | 273/73 G |

FOREIGN PATENT DOCUMENTS

| | | | |
|---|---|---|---|
| 252990 | 7/1964 | Australia | 273/73 D |
| 2049750 | 5/1972 | Fed. Rep. of Germany | 273/73 E |
| 2513567 | 10/1976 | Fed. Rep. of Germany | 273/73 E |
| 2752624 | 5/1979 | Fed. Rep. of Germany | 273/73 C |
| 308297 | 5/1933 | Italy | 273/73 D |

*Primary Examiner*—Richard J. Apley
*Attorney, Agent, or Firm*—Max Fogiel

[57] ABSTRACT

A racket for ball games has a frame and a handle extending from it. It has crosswise string sections and longitudinal string sections, and the longitudinal string sections closest towards the center of the hitting surface of the racket extend slidably out of the frame deep into the handle where they are secured.

6 Claims, 2 Drawing Figures

BALL-PLAYING RACKET

BACKGROUND OF THE INVENTION

This invention relates generally to a ball racket, and more particularly—but not exclusively—to a tennis racket.

Tennis rackets are known in which the frame wherein the strings form the ball hitting surface, defines a closed oval from which a handle extends in the direction of the longer axis of the oval. Other tennis rackets also usually have oval frames which are formed of one piece from a rod that is bent to the appropriate shape at its center section and the end sections of which converge in generally V-shaped configuration and are then extended in parallel to one another to form the handle. This leaves at the junction of the hitting surface and the handle a space, the so-called "throat", in which an appropriately shaped insert is mounted. In all instances the free end of the handle is terminated with an end piece shaped to fit the hand of a user.

The oval form of the racket head is not the only one that is known. It is also known to form the racket head in a circular configuration. The oval shape, however, has the advantage that the string sections (there may be a single string which constitutes all string sections forming the hitting surface, or there may be individual strings for each string section or for a group of string sections) which extend in the center region of the hitting surface towards the handle, are longer than the cross-wise extending string sections located at the middle of the hitting surface. This increases the hitting surface area having the optimum effect (i.e. the area having the strongest spring back effect) in the direction of the longitudinal axis (i.e. the long axis of the oval) of the hitting surface. Thus, even balls which hit the hitting surface not in the center region but offset in direction towards the handle, encounter a hitting surface area having a high spring back effect. Since the longitudinal axis of the handle approximately constitutes an extension of the arm of the player, such offset hitting of the ball does not constitute any disadvantage to the player. An increase of the hitting surface area with optimum effect in direction transfers to the longitudinal axis of the handle, however, is not advisable because balls which contact the hitting surface laterally offset from the central region cause the racket to perform a partial turn about its longitudinal axis and this can lead to injuries to the player, for example the development of the so-called "tennis elbow".

SUMMARY OF THE INVENTION

It is an object of the invention to further improve a ball racket, particularly a tennis racket.

A more particular object is to provide such an improved racket in which the hitting surface area having the optimum spring back effect is increased in longitudinal direction, i.e. lengthwise of the handle, without increasing the overall area of the hitting surface and without thus increasing the weight of the racket.

Pursuant to these objects, and others which will become apparent hereafter, one feature of the invention resides in a racket, particularly a tennis racket, which comprises a substantially annular frame, a handle extending from the frame and having a longitudinal axis coincident with a symmetry line of the frame and passing through the center of the frame, and a plurality of first string sections spanning the frame in a first direction, and a plurality of second parallel string sections extending across the first string sections and spanning the frame in a second direction parallel to the longitudinal axis. According to the invention, at least that one of the second string sections which is closest to the symmetry line and the two second string sections which flank it extend slidably through the frame and into the handle where they are secured.

In a racket constructed according to the present invention the hitting surface area having the highest spring back effect is increased in direction lengthwise of the handle, i.e. lengthwise of the over all racket, and furthermore a better ball guidance is achieved since the ball remains for a longer period of time on the hitting surface. Also, the lifetime of the stringing is increased.

It is advantageous to have the aforementioned one and two second string sections extend into the handle by a distance corresponding to approximately 20–50% of the overall length of the respective one of these three string sections.

In order to be able to employ the concept of the invention in a racket in which the frame is formed from the center section of a rod which is bent to appropriate shape and the handles are formed by the end sections of the rod, a further concept of the invention provides for the aforementioned one and two second string sections to be slidably guided in that edge face of the insert in the throat, which faces the interior of the frame, i.e. the hitting surface. It is advantageous for the aforementioned one and two second string sections to converge from this edge face towards the opposite edge face of the insert, i.e. the edge face which is distal from the one just mentioned, and to secure them at this second or opposite edge face. This permits both the guidance and the mounting of these one and two second string sections to be effected by means of a single component.

According to another advantageous concept of the invention, in which the entire stringing of the racket is constituted of a single string, the aforementioned one and two second string sections may be looped about a transverse bolt, pin or similar element which traverses the handle and is with advantage formed directly on the insert itself. This is a particularly simple way of securing the string sections.

The invention will hereafter be described with reference to an exemplary embodiment as illustrated in the drawing. However, the description and illustration are not to be considered limiting of the inventive concept.

DESCRIPTION OF PREFERRED EMBODIMENTS

Figure 1:
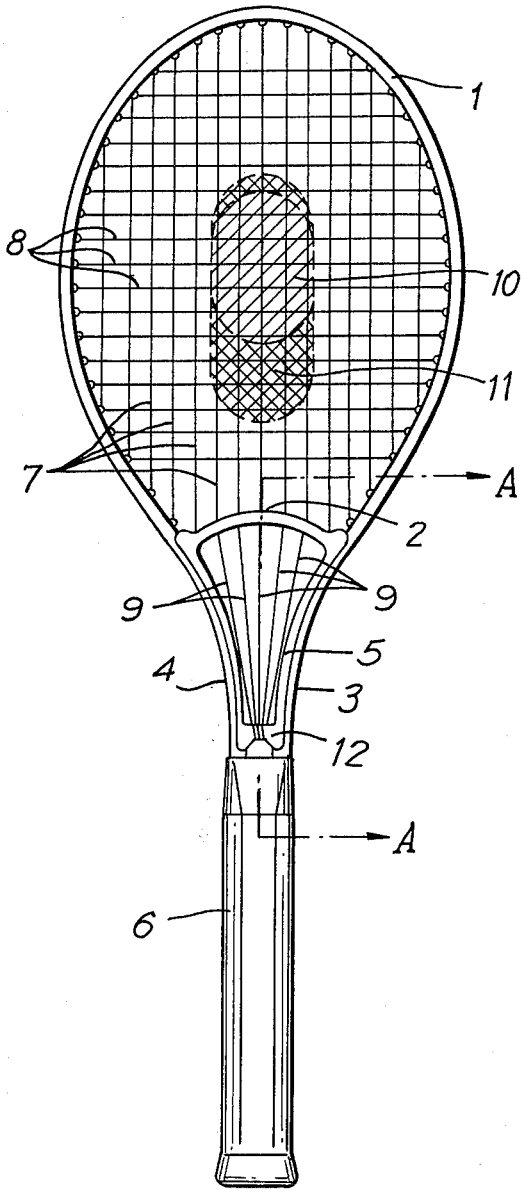
FIG. 1 is a top-plan view of a racket embodying the invention.
Figure 2:
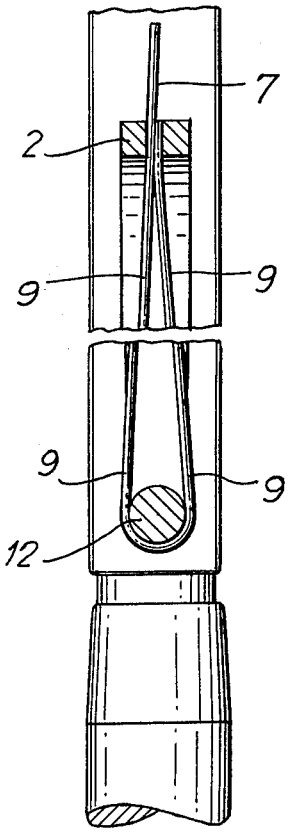
FIG. 2 is a fragmentary section taken on line A—A of FIG. 1.

The racket illustrated in FIGS. 1 and 2 has a substantially annular frame, namely a frame which is of oval outline and is formed by bending the center section of a rod 1 to the appropriate shape. The two end sections 3 and 4 of the rod converge with one another so as to define a generally V-shaped throat in which an insert 5 is mounted. The edge face 2 of this insert 5 which faces inwardly of the frame serves in part to bound the hitting area of the frame. The two end sections 3 and 4 have mounted on them an appropriate terminal part which finishes off the handle 6 and is dimensioned so as to be accommodated to the size of the player's hand. The hitting area in this particular embodiment, i.e. the area surrounded by the frame 1, 2, is strung with a single string which forms a plurality of longitudinally extending parallel string sections 7 and transversely extending string sections 8.

The longitudinal string sections 7 and transverse string sections 8 are secured to the rod 1, except for the end portion 9 of the longitudinal string sections 7 which pass through the center area of the hitting surface which is produced by the string sections 7 and 8. These end portions 9 extend through the edge face 2 of the insert 5 so that they have freedom of sliding movement and are secured to the edge face 12 of the insert 5, which is remote from the edge face 2 and is located deep within the handle 3, 4. The thus obtained extension of these particular longitudinal string sections 7 creates an increase of the area having the optimum spring back effect, in that it increases the size of the normal area (designated by reference numeral 10 and hatched in one direction only) by the size of the second area 11 (cross hatched for distinction), so that the overall maximum spring back area is now composed of the two areas 10 and 11.

As shown particularly in FIG. 2, it is advantageous if the end of the insert 5 which is remote from the edge face 2, is formed as a rod, pin, bolt or the like 12 as shown in FIG. 2, since then the end portions 9 can simply be looped about it.

The part of the insert 5 having the edge face 2 is convex in direction towards the hitting area, but the bores formed in it through which the portions 9 of the respective longitudinal string sections 7 extend, are oriented so as to extend lengthwise of these string sections. The outlet openings of these bores which is obtained in this manner has a favorable influence on the life of the stringing, i.e. the stringing will last longer than would otherwise be the case.

The invention has been described herein with reference to the embodiment illustrated in FIGS. 1 and 2, but it should be understood that it is not limited to this particular embodiment and that all variations and modifications which will suggest themselves to persons of ordinary skill in the art are intended to be encompassed within the appended claims.

What is claimed is:

1. A racket, particularly a tennis racket, comprising: a substantially loop-shaped frame bent from a rod-shaped member; elastic strings spanning criss-cross said frame; said frame having two converging end portions defining a V-shaped section; a framed wedge-shaped member inserted in said V-shaped section between said end portions and being immovably secured thereat and having a side bordering the surface formed by said strings spanning criss-cross said frame; a handle extending said end portions, said end portions extending substantially deep into said handle; a plurality of said strings extending lengthwise at the center region of said surface and being guided with freedom of sliding movement through said side of said wedge-shaped member and passed through said wedge-shaped member; said wedge-shaped member having sides extending along a portion of said end portions and having terminal portions converging to an intersection, means attaching said terminal portion, said plurality of strings after passing through said wedge-shaped member being attached to said attachment means, said plurality of strings converging within said wedge-shaped member to said attachment means and being visible through a free open central region of said wedge-shaped member.

2. A racket as defined in claim 1 wherein said plurality of strings extending lengthwise have portions passing through said wedge-shaped member which are substantially 20–50% of the overall length of the respective strings extending lengthwise.

3. A racket as defined in claim 1 wherein said strings spanning criss-cross said frame comprise an endless member; and wherein said plurality of strings being looped about said attachment means.

4. A racket as defined in claim 3 wherein said attachment means and said wedge-shaped member are comprised of a single-piece member.

5. A racket as defined in claim 1 wherein said side of said wedge-shaped member has a convex-shape in a direction towards the hitting area of said racket, said side having bores for passage of said lengthwise extending strings, said bores being oriented so that they extend lengthwise of said plurality of strings extending lengthwise at the center region of said surface, so that said bores have outlet openings for influencing the useful life of said strings.

6. A racket as defined in claim 1 wherein said side of said wedge-shaped member has a convex shape in direction towards the hitting area of said racket, said side having bores for passage of said lengthwise extending strings, said bores being oriented so that they extend lengthwise of said plurality of strings extending lengthwise at the center region of said surface, so that said bores have outlet openings for influencing the useful life of said strings; said strings spanning criss-cross said frame comprising a single endless member, said plurality of strings being looped about said attachment means, said plurality of strings passing through said wedge-shaped member having lengths of substantially 20–50% of the overall length of the respective lengthwise strings, said attachment means and said wedge-shaped member comprising a single-piece member.

* * * * *